US007533946B2

(12) United States Patent
Hoffman

(10) Patent No.: US 7,533,946 B2
(45) Date of Patent: May 19, 2009

(54) CLOSING DEVICE FOR DRAWERS

(75) Inventor: Keith A. Hoffman, Hudsonville, MI (US)

(73) Assignee: Knape & Vogt Manufacturing Company, Grand Rapids, MI (US)

( * ) Notice: Subject to any disclaimer, the term of this patent is extended or adjusted under 35 U.S.C. 154(b) by 528 days.

(21) Appl. No.: 11/211,795

(22) Filed: Aug. 25, 2005

(65) Prior Publication Data

US 2007/0046158 A1 Mar. 1, 2007

(51) Int. Cl.
*A47B 88/04* (2006.01)

(52) U.S. Cl. ..... 312/333; 312/334.6; 312/319.1

(58) Field of Classification Search ..... 312/330.1, 312/333, 334.1, 334.6, 334.7, 334.8, 334.46, 312/334.47, 319.1, 319.2, 334.14, 334.15; 384/20, 21, 22

See application file for complete search history.

(56) References Cited

U.S. PATENT DOCUMENTS

| | | | |
|---|---|---|---|
| 3,104,142 | A | 9/1963 | Knape et al. |
| 3,139,313 | A | 6/1964 | Rule |
| 3,243,247 | A | 3/1966 | Knape |
| 3,574,437 | A | 4/1971 | Stein et al. |
| 3,658,398 | A | 4/1972 | Abbate, Jr. |
| 3,697,140 | A | 10/1972 | Livingston |
| 3,954,315 | A | 5/1976 | Sanden |
| 3,973,814 | A | 8/1976 | Entrikin |
| 4,558,908 | A | 12/1985 | Rock et al. |
| 4,615,095 | A | 10/1986 | Bessinger |
| 4,659,237 | A | 4/1987 | Rapp |
| 5,015,048 | A | 5/1991 | Brunnert |
| 5,020,868 | A | 6/1991 | Brunnert |
| 5,026,176 | A | 6/1991 | Jensen et al. |
| 5,040,833 | A | 8/1991 | Brunnert |
| 5,056,879 | A | 10/1991 | Rock |
| 5,135,294 | A | 8/1992 | Ohshima et al. |
| 5,207,781 | A | 5/1993 | Rock |
| 5,275,483 | A | 1/1994 | Rasmussen |
| 5,302,016 | A | 4/1994 | Lautenschlager et al. |
| 5,344,227 | A | 9/1994 | Rock et al. |
| 5,364,179 | A | 11/1994 | Brustle et al. |

(Continued)

FOREIGN PATENT DOCUMENTS

| | | | |
|---|---|---|---|
| DE | 4242717 | A1 | 7/1993 |

(Continued)

*Primary Examiner*—James O Hansen
(74) *Attorney, Agent, or Firm*—Cook Alex Ltd.

(57) ABSTRACT

A closing device for drawers, the device having a housing with a holding notch and a slider having a resilient latching arm that is bendable to engage the holding notch, as well as a spring that engages the housing and the slider to urge the slider to a rearward position relative to the housing. The resilient latching arm has a slot adapted to receive a pin, whereby as the drawer is moved from its closed position, the relative movement of the pin advances the slider to a position where the resilient latching arm engages the holding notch and the drawer is free to mover further outward without influence of the closing device. As the drawer is moved rearward toward its closed position, the relative movement of the pin will cause it to engage the slot in the resilient latching arm, further causing it to release from the holding notch and to be urged by the spring to move the drawer toward a closed position.

29 Claims, 11 Drawing Sheets

U.S. PATENT DOCUMENTS 5,474,375 A 12/1995 Hollenstein et al.
5,484,209 A 1/1996 Weng
5,490,724 A 2/1996 Domenig
5,580,138 A 12/1996 Grabher
5,584,550 A 12/1996 Kueng
5,641,216 A 6/1997 Grass
5,671,988 A 9/1997 O'Neil
5,730,514 A 3/1998 Hashemi
5,733,027 A 3/1998 Lautenschlager
5,757,109 A 5/1998 Parvin
5,769,518 A * 6/1998 Grabher ..... 312/334.6
5,775,787 A 7/1998 Gasser
5,882,100 A 3/1999 Rock
5,975,662 A 11/1999 Weber
5,980,007 A 11/1999 Singh
5,988,780 A 11/1999 Rock et al.
6,015,199 A 1/2000 Netzer et al.
6,027,193 A 2/2000 Domenig et al.
6,244,678 B1 6/2001 Dopp et al.
6,254,205 B1 7/2001 Wright et al.
6,340,078 B1 1/2002 Scheible
6,390,574 B2 5/2002 Fraccaro
6,412,891 B1 7/2002 Liang et al.
6,629,738 B2 10/2003 Salice
6,672,692 B2 * 1/2004 Weng ..... 312/333
6,712,435 B2 3/2004 Kim et al.
6,733,097 B2 5/2004 Kim et al.
6,953,233 B2 * 10/2005 Lam et al. ..... 312/333
2001/0006319 A1 7/2001 Dopp et al.
2002/0033658 A1 3/2002 Salice
2003/0067257 A1 4/2003 Gasser
2003/0132688 A1 7/2003 Lackey et al.
2003/0189395 A1 10/2003 Doornbos et al.

FOREIGN PATENT DOCUMENTS

DE 4301327 A1 8/1993
EP 0743032 B1 11/1996

* cited by examiner

CLOSING DEVICE FOR DRAWERS

BACKGROUND OF THE INVENTION

1. Field of the Invention

The present invention generally relates to closing devices for drawers, often incorporated into drawer slides otherwise known as self-closing drawer slides. Such drawer slides tend to be used in articles of furniture, such as cabinets, for assisting in moving a drawer to a fully closed position within the cabinet body.

2. Discussion of the Prior Art

Articles of furniture having drawers, such as cabinets, typically include drawer slides for mounting the drawers to the cabinet and for providing a way to move the drawer between a fully closed position within the cabinet body to an open position with the drawer extending outward from the cabinet body. Standard drawer slides tend to be mounted in pairs, with one on each of the left and right outer sides of the drawer. In such configuration, one drawer slide member is attached to the cabinet body and a second drawer slide member is attached to the outer side of the drawer. Bearings, such as ball or roller bearings, typically are disposed between the drawer slide members for smooth movement of the drawer relative to the cabinet body. The bearings may be organized and located within a bearing retainer. Also, there may be a third drawer slide member coupled to and between the first and second drawer slide members, with a corresponding additional set of bearings, to permit further extension of the drawer from the cabinet body. Mounting drawer slides on the sides of the drawer necessarily requires that the drawer body be considerably narrower than the opening in the cabinet for the drawer.

Alternatively, drawer slides may be of an undermount configuration wherein the second drawer member of each of the drawer slides is located beneath and at a respective outer side edge of the drawer bottom. In the undermount configuration, the drawer may be much closer to the width of the opening in the cabinet because each drawer slide member is not located entirely between a cabinet side and a drawer side. In both the standard and undermount configurations, it is desirable to assist a user in closing a drawer, to prevent rebound of the drawer, and to tend to hold the drawer in a closed position.

There are numerous self-closing drawer slide devices designed to be engaged as a drawer is being closed and reaches a predetermined distance from the cabinet face. Such devices often incorporate a spring to help push or pull the drawer to the fully closed position. It is common for these devices to include a latching member that is tiltable or pivotable, so as to be used in controlling the movement of the drawer relative to the cabinet body within a pre-selected range of motion of the drawer. Such prior art devices often include a pin or tab to force the latching member to tilt or pivot from a latched to an unlatched position or vice versa. In turn, either the latching member or pin commonly is associated with one of the drawer sides or slide members, while the other corresponding component is associated with the other drawer slide member.

In some other prior art devices, the latching member may be on a slider that moves both longitudinally and laterally, along an L or J shaped slot in a planar wall of a housing, as the drawer moves within a pre-selected range of travel when nearly closed. These devices also may include a specialized angular slot at the end of one of the drawer slide members, so as to engage a post or other protrusion extending from the body of the slider, to effectively move the latching member between latched and unlatched positions.

While such tiltable or pivotable latching member and pin assemblies function for their intended purpose, they present potential problems in regard to wear of the pivoting and spring components, noise associated with the pivoting components as they move from one position to another, as well as noise associated with the spring as it is bent or shifts within its mounting relationship with the latching member or housing as the latching member tilts, pivots and/or translates. In some prior art devices, a coiled spring is used and moves between a compressed and a relaxed position to push a drawer closed. However, use of a spring in compression requires control of the spring as it is compressed, to prevent the spring from buckling outward in the middle. Sometimes the spring in such devices is referred to as a compression spring. To control a compression spring, it has been common to use a pin or rod through the center of the spring, or walls in close relation to each other to contain the spring at one end of the latching member. In other prior art devices, springs are used and are stretched with movement of the slider to the latched position, with the springs sometimes being referred to as extension springs. This stretching may occur with the spring having to bend or interfere with housing walls due to the path of the slider.

It is desirable to provide a closing device for drawers that can be incorporated into drawer slides, including undermount drawer slides, while avoiding the potential disadvantages of self-closing drawer slides that use latching members that tilt, rotate or translate both longitudinally and laterally. Accordingly, it is desirable to provide a simplified closing device which eliminates the tilting, pivoting or multi-directional translational movement of a latching member. Thus, it is desirable to provide a housing and a simplified slider having a latching member where the slider moves only along one axis. This is desirable to avoid excess noise that may be associated with components that rotate or pivot from one extreme position to another. This simplified housing and corresponding slider with latching member is suited for use with springs that may be extended or compressed during the course of the movement to the latched position. Indeed, this permits a spring to be used in tension to avoid the need for a pin or rod through the spring or containment walls, either of which prevents buckling via contact with the coils of the spring as it moves, but which also tends to impart undesirable noise due to the contact necessary to prevent the buckling. Alternatively, the invention may be configured to use a spring in compression, while still benefiting from the simplified structure that permits relatively limited movement of the slider having the latching member attached thereto. Hence, the present invention addresses shortcomings in prior art self-closing drawer slide assemblies, while providing quiet, smooth-operating closing devices for use with a drawer slide.

SUMMARY OF THE INVENTION

The purpose and advantages of the invention will be set forth in or otherwise apparent from the description and drawings that follow, as well as will be learned by practice of the invention.

The present invention is generally embodied in a closing device for drawers. In a first aspect of the invention, a closing device, for use in an article of furniture having furniture components including a furniture body and a drawer slidable in opposite directions rearward into and forward out of the furniture body, for moving the drawer rearward to a fully closed positioned within the furniture body is presented. The closing device has a first slide member connected to the drawer, a second slide member connected to the cabinet and slidably coupled to the first slide member, a housing connected to the second slide member, a slider slidably received in the housing and having a resilient latching arm. The resilient latching arm further has a slot and a latching portion, with the resilient latching arm being bendable between a first position, wherein the latching portion engages a notch on the housing and a second position wherein the latching portion is released from the notch and the slider is permitted to move rearward within the housing. The closing device further has a pin member connected to the first slide member and engagable with the slot in the resilient latching arm, and a spring disposed between the housing and the slider, with the spring being adapted to urge the slider to move rearward relative to the housing.

In a further aspect of the invention, a closing device, for use in an article of furniture having furniture components including a furniture body and a drawer slidable in opposite directions rearward into and forward out of the furniture body, for moving the drawer rearward to a fully closed positioned within the furniture body is presented. The closing device has a pin member adapted to be mounted to one of the furniture components, a housing adapted to be mounted to the other of the furniture components, a slider having a resilient latching arm, wherein the slider slidably engages the housing and is movable in a rectilinear path relative to the housing. The resilient latching arm further has a latching portion and a slot, wherein the pin is adapted to engage the slot and when the pin engages the slot the slider is movable between a first position wherein the pin extends into the slot and a second position wherein the pin forces the resilient latching arm to bend until the latching portion engages a notch on the housing and the pin is removed from the slot. The closing device further has a spring engaging the slider and the housing to urge the slider toward the first position such that when the pin is engaged in the slot and the latching portion is not engaged in the notch on the housing, the furniture component to which the pin is mounted is urged to move relative to the other furniture component so as to move the drawer rearward to a closed position.

In a further aspect of the invention, the closing device may be configured for use with a spring that tends to be compressed when the latching portion is engaged with the holding notch.

In yet a further aspect of the invention, the closing device may be configured for use with a spring that tends to be extended when the latching portion is engaged with the holding notch.

In still a further aspect of the invention the closing device may be configured for direct mounting to a furniture or drawer body, or for mounting on one or more drawer slide members.

Thus, the present invention presents an alternative to prior art closing devices for drawers. The present invention also simplifies the structure to permit smoother and quieter operation of a self-closing drawer slide. The present invention eliminates the wear and noise typically associated with tiltable or pivotable latching members, as well as much of the complexity and noise associated with prior art devices which utilize a latching member that moves in multiple directions in association with a slot in a planar wall.

It is to be understood that both the foregoing general description and the following detailed description are exemplary and provided for purposes of explanation only, and are not restrictive of the invention, as claimed. Further features and objects of the present invention will become more fully apparent in the following description of the preferred embodiments and from the appended claims.

BRIEF DESCRIPTION OF THE DRAWINGS

In describing the preferred embodiments, reference is made to the accompanying drawing figures wherein like parts have like reference numerals, and wherein.

Figure 1:
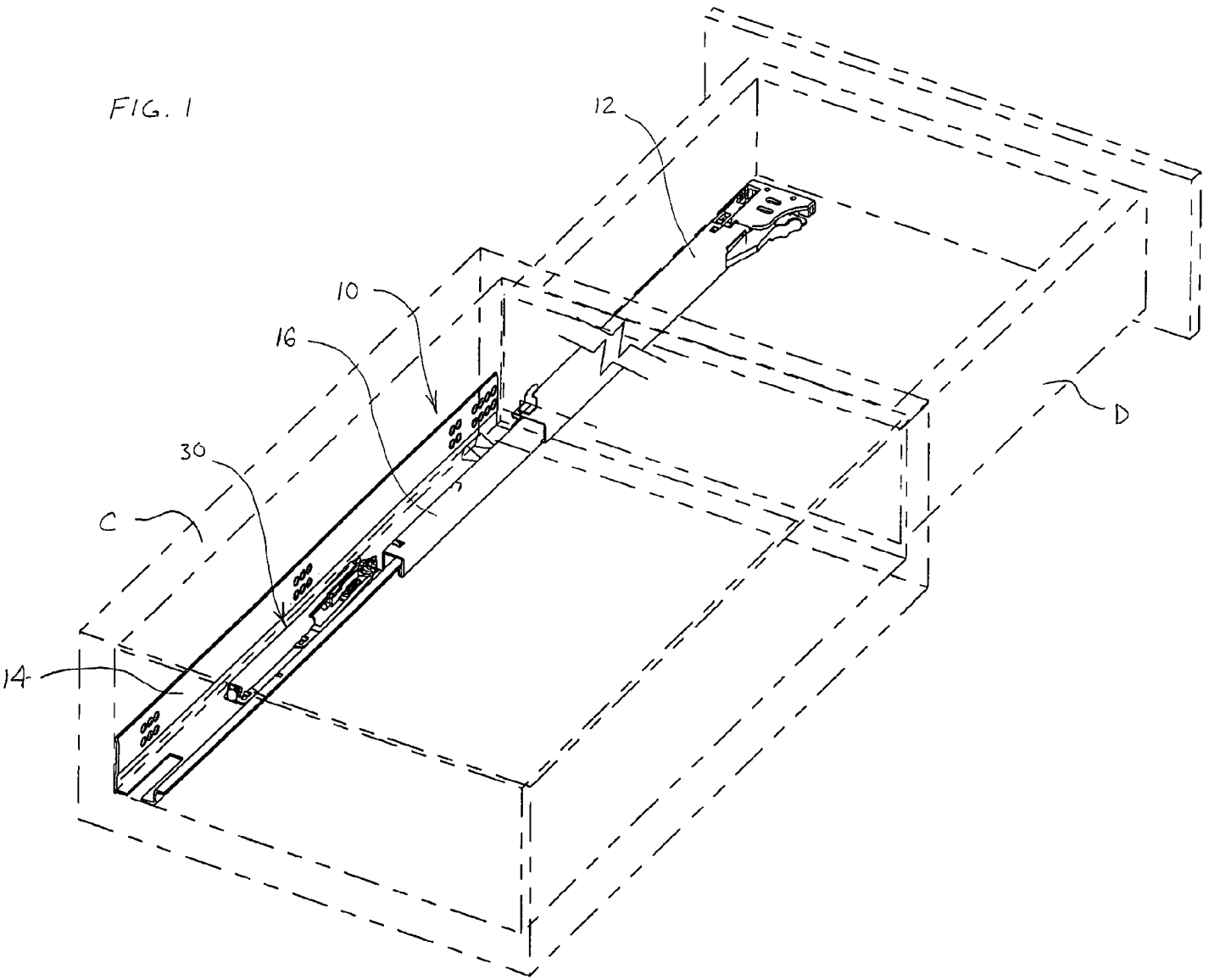
FIG. 1 is a perspective view of a first preferred embodiment of a closing device for a drawer consistent with the present invention and shown incorporated into an undermount drawer slide and in relation to its mounting to a drawer in a cabinet.
Figure 2:
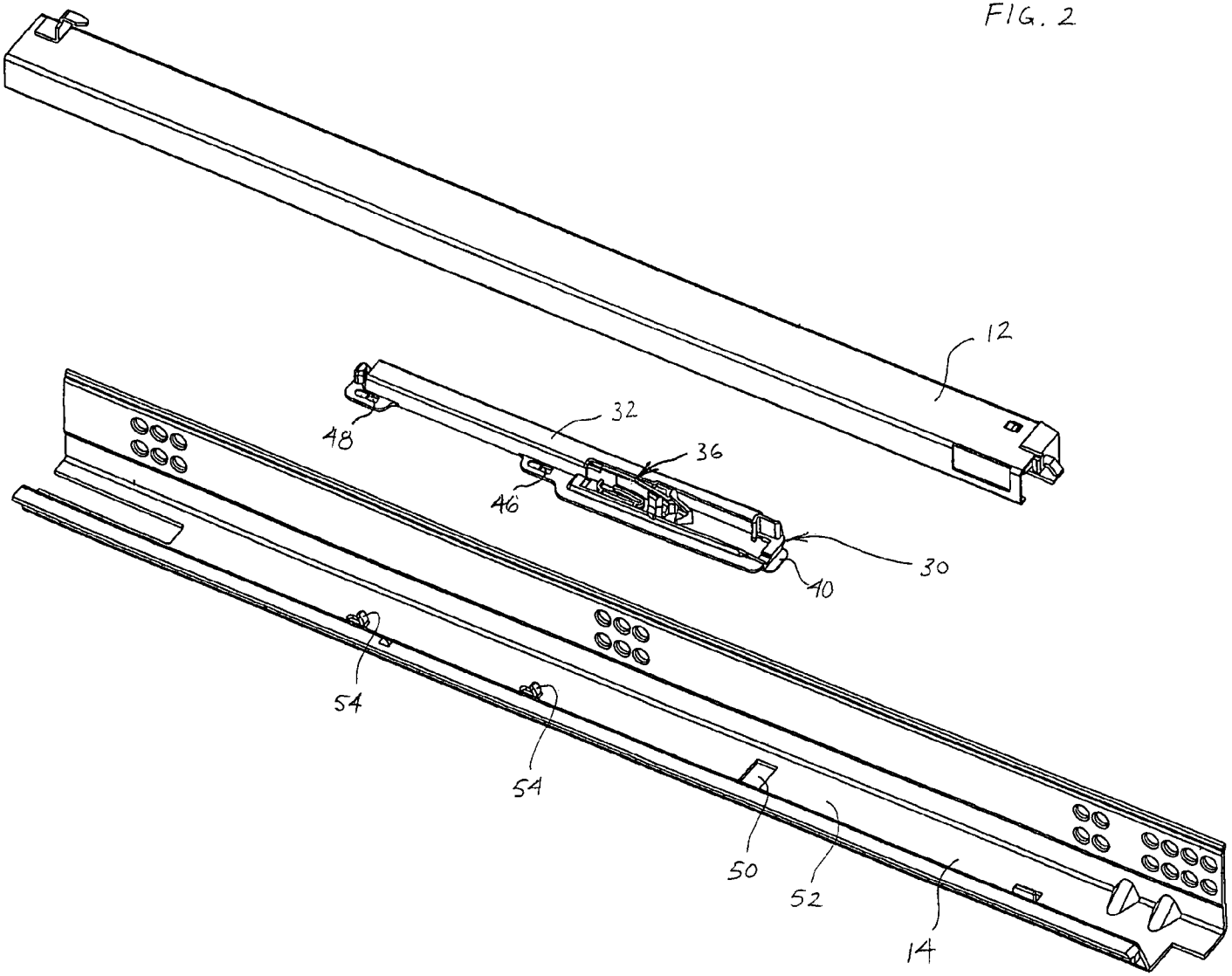
FIG. 2 is an exploded perspective of components of the first preferred embodiment.
Figure 3:
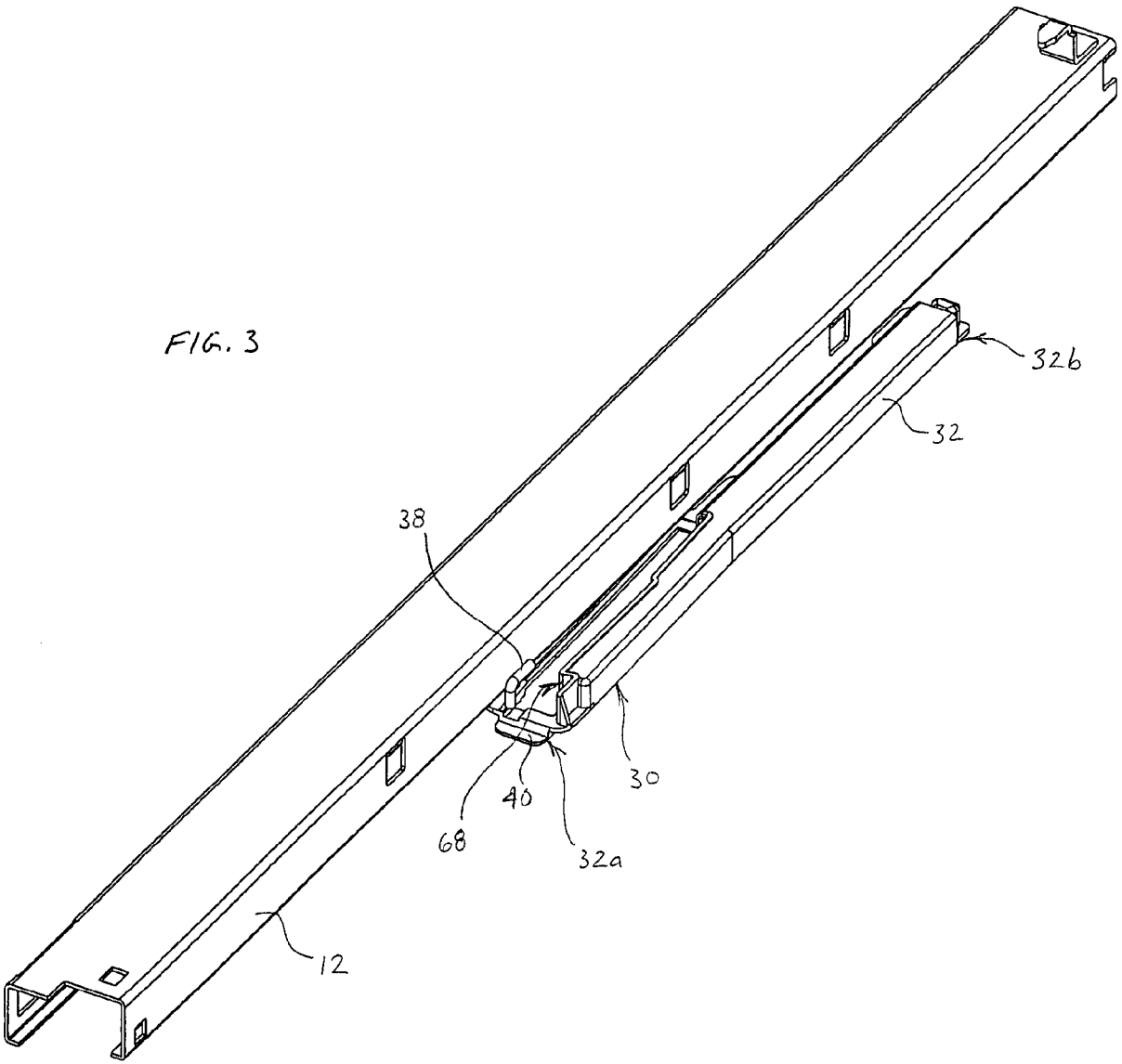
FIG. 3 is a perspective view of the relative position of the first drawer slide member and the self-closing mechanism of the first preferred embodiment.

It should be understood that the drawings are not to scale and provide various views of assemblies that are within the spirit and scope of the invention which may be used in various configurations of closing devices for drawers. While considerable mechanical details of closing devices for drawers, including other plan and section views of the particular components, have been omitted, such details are considered well within the comprehension of those skilled in the art in light of the present disclosure. It also should be understood that the present invention is not limited to the preferred embodiments illustrated.

DETAILED DESCRIPTION OF THE PREFERRED EMBODIMENTS

Referring generally to FIGS. 1-10, it will be appreciated that the drawer closing device of the present invention generally may be embodied within numerous configurations within a device that may be incorporated into a self closing drawer slide.

Referring to a preferred embodiment in FIGS. 1-7, a drawer closing device 10 is shown incorporated into the form of a self-closing drawer slide. The drawer closing device 10 is shown having a first drawer slide member 12 for attachment by conventional means to a drawer D (shown in phantom), a second drawer slide member 14 for attachment by conventional means to a cabinet C (shown in phantom), and third drawer slide member 16 slidably engaging the first and second drawer slide members 12 and 14, respectively. Use of third drawer slide member 16 permits greater extension of drawer D from the face of cabinet C when in the fully opened position (as shown), and often drawer slides of this type are referred to as full extension drawer slides. However, while the self-closing drawer slide in the drawer closing device 10 of the preferred embodiment is configured to be of the full extension undermount type, it will be appreciated that the drawer closing device of the present invention could be incorporated into other configurations, whether as incorporated into two or three slide member drawer slides, into drawer slides of the side or undermount type, or in direct mountings to a drawer and cabinet without being incorporated into one or another drawer slide member.

Figure 7:
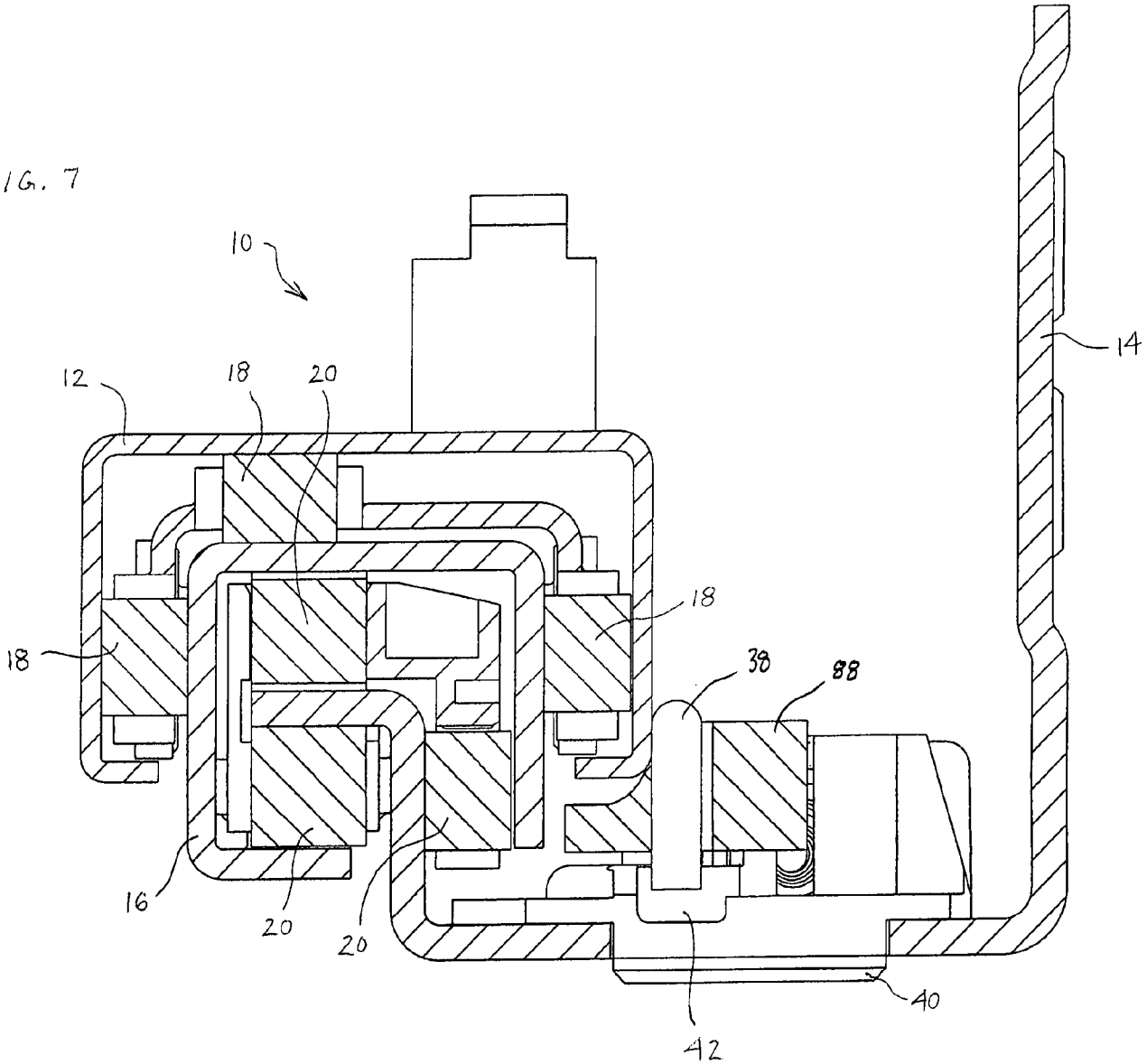
FIG. 7 is a cross-sectional view of the first preferred embodiment of a closing device for a drawer.

As best seen in FIG. 7, for the preferred embodiment, slidable engagement between the respective drawer slide members 12 and 16 is achieved with use of bearings 18. Bearings 18 are preferably of the plastic roller bearing type, but it will be appreciated that the slidable engagement could be achieved with other types of bearings, such as ball bearings, or other slide elements, and that such alternative components could be made of various other suitable materials, such as steel, metal alloys or the like. Similarly, slidable engagement of drawer slide members 12 and 14 is achieved with use of bearings 20, which may be but need not be of the same type as bearings 18.

As shown in the preferred embodiment in FIG. 1, a self-closing mechanism 30 is connected to the second drawer slide member 14 approximately midway along its length, which facilitates more flexible mounting of second slide member 14 at the rear of cabinet C. Self-closing mechanism 30 preferably has three main components: a housing 32, a spring 34 and a slider 36, which are configured to interact with a corresponding pin 38 which is coupled or connected to first drawer slide member 12. Pin 38 is preferably of rigid material, such as circular 0.1" steel wire, welded or otherwise affixed to first drawer slide member 12. It will be appreciated that pin 38 may alternatively be made of other suitable materials and mounted in other conventional ways, as well as it may be coupled to extend from drawer D directly. It also will be appreciated that the mounting of the components may be reversed to associate pin 38 with second drawer slide member 14 or directly with an interior wall of cabinet C, while self-closing mechanism 30 would then be associated with first drawer slide member 12 or directly with drawer D.

In the first preferred embodiment, housing 32 is configured to be readily attachable to a second drawer slide member 14 by use of particular features to facilitate simple, rapid and secure mounting that also reduces the potential for interference with pin 38. For instance, housing 32 includes tab 40 at forward housing end 32*a*. Tab 40 is preferably configured to engage aperture 50 (best seen in FIG. 2) in the web 52 of second slide member 14, so as to locate the bottom of channel 42 (best seen in FIG. 4A) flush with the top surface of web 52. This can be achieved if the thickness of the material below channel 42 and above tab 40 is similar to the thickness of the material of web 52. This flush arrangement permits pin 38 to be of greater length to ensure appropriate engagement with slider 36. Housing 32 also includes protrusions 44 adjacent tab 40 (best seen in FIG. 4B) which are used to allow aperture 50 to be large enough for easy insertion of tab 40 while then preventing housing 32 from moving rearward when adjacent web 52. Housing 32 also includes aperture 46 relatively centrally located and aperture 48 adjacent rearward housing end 32*b* to receive mounting tabs 54 formed in web 52.

Figures 4A, 4B:
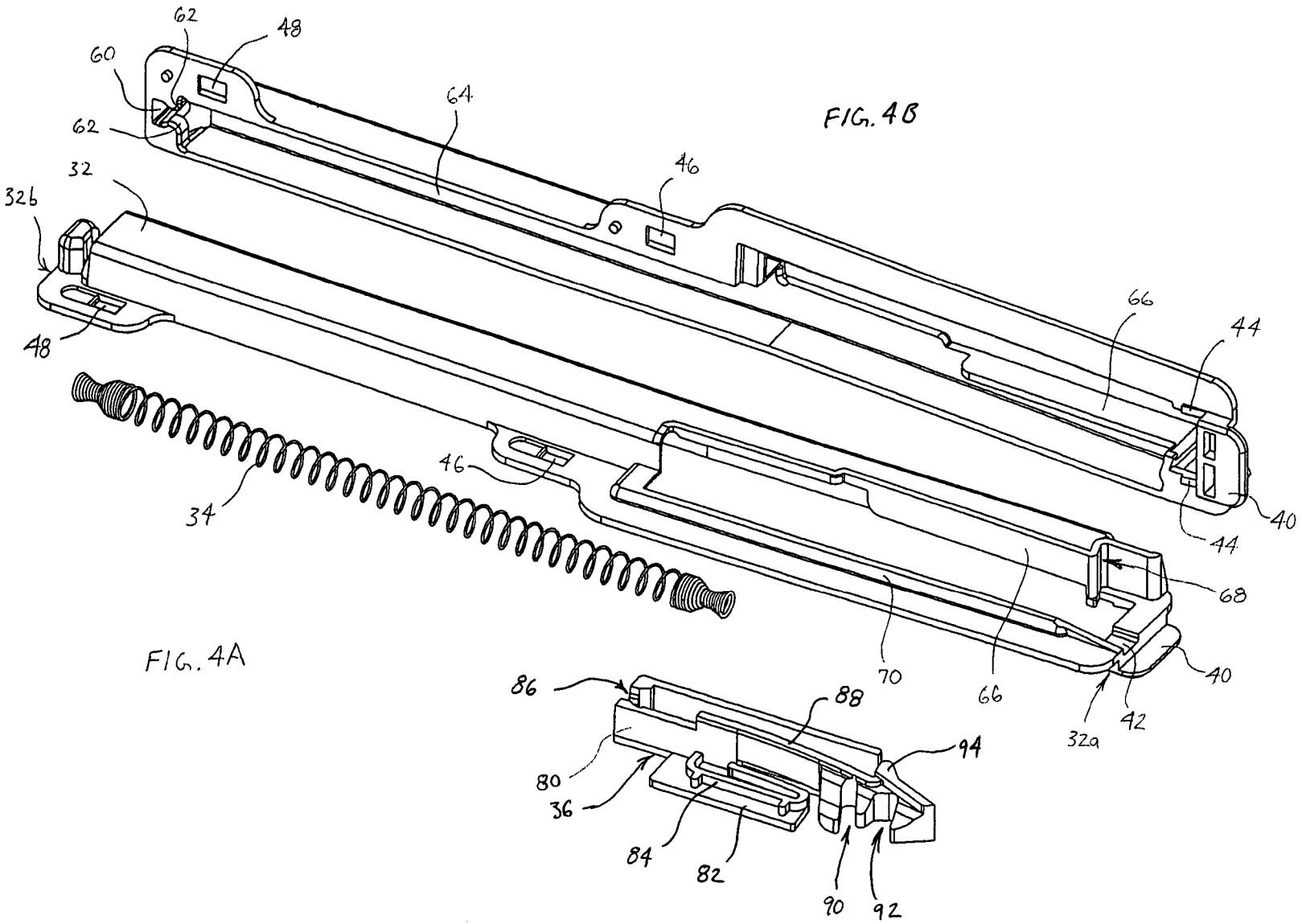
FIG. 4A is an exploded perspective exploded view of components of the self-closing device shown of the first preferred embodiment.
FIG. 4B is a perspective view of the housing shown in FIG. 4A rotated onto its side.

Housing 32 accommodates spring 34 with spring mounting socket 60 having ridges 62 for snap fit mounting of a first formed end of spring 34 (shown in an extended position in FIG. 4A). Spring 34 is located within elongated channel 64 of housing 32 and socket 60 and its ridges 62 assist in keeping spring 34 centrally located so as to avoid contact with the walls of housing 32 and the top surface of web 52, and the resultant noise associated with such contact. Selecting a proper length for spring 34 also is important to achieving clearance in all positions of spring 34 relative to housing 32 and web 52. Housing 32 further includes guide wall 66 which is preferably perpendicular to web 52 when housing 32 is mounted to second slide member 14. Guide wall 66 terminates at its forward end in holding notch 68. Housing 32 also includes further guide wall 70 which is parallel to and spaced from web 52. The guide walls 66 and 70, and holding notch 68 will be discussed in more detail below in regard to their function and interaction with slider 36.

Slider 36 is preferably constructed of molded plastic and may be formed of a single piece or an assembly of components. Slider 36 has a body 80 atop a base 82. Base 82 extends laterally to be located below and in sliding engagement with guide wall 70 of housing 32. Base 82 includes a patterned upstanding protrusion 84 to ensure slider 36 will stay parallel to the edge of guide wall 70 as it slides forward and rearward. Upstanding protrusion 84 may alternatively be one or more independent projections. Body 80 of slider 36 terminates in a rearward end with a spring mounting socket 86, similar in structure to spring mounting socket 60 on housing 32 as previously discussed. Body 80 has a forward extending resilient latching arm 88 for interaction with housing 32 and pin 38.

Figure 5A:
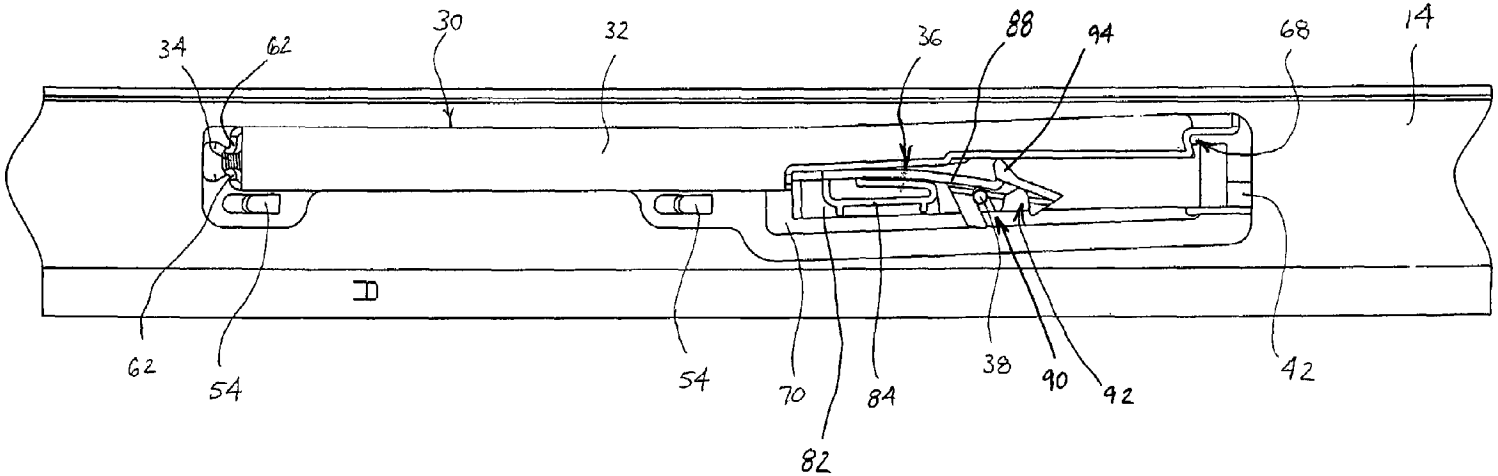
FIG. 5A is a top view of the self-closing mechanism mounted to the second drawer slide member of the first preferred embodiment, with the slider and drawer pin shown in their respective positions when the drawer is closed.
Figure 6A:
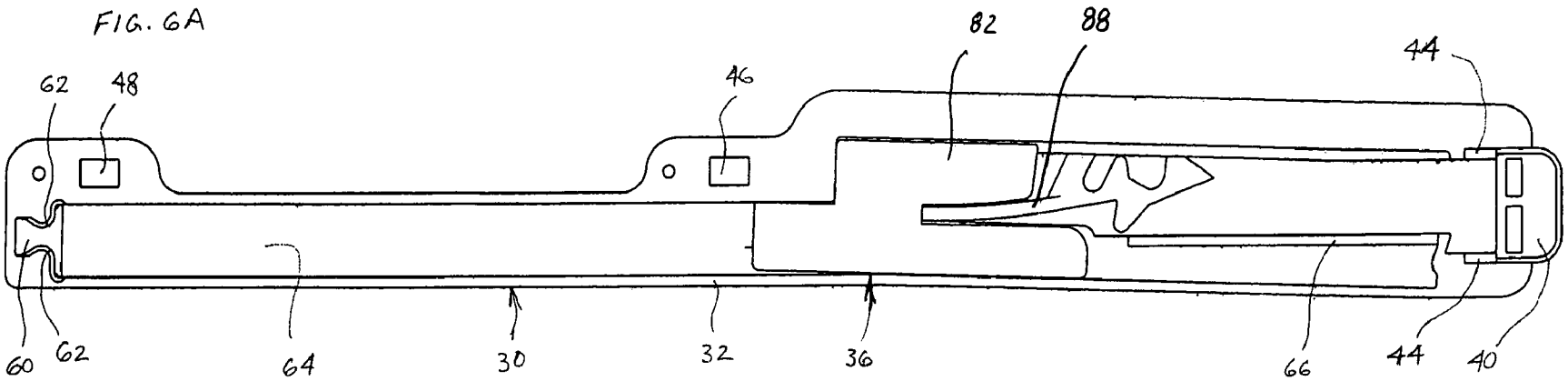
FIG. 6A is a bottom view of the housing and slider components of the closing mechanism of the first preferred embodiment with the slider setting idle at a first end of its travel.

In the preferred embodiment, resilient latching arm 88 extends forward and includes a first slot 90, a second slot 92, and a latch portion 94. Pin 38 is mounted in a location on first drawer slide member 12 so that when drawer D is in the closed position, fully within cabinet C, pin 38 is located within first slot 90, as best seen in FIGS. 5A and 6A. If resilient latching arm 88 is of polymeric material, it is preferred that slider 36 be molded so that in the position shown in FIGS. 5A and 6A, resilient latching arm 88 is in a relaxed position. Given that a cabinet drawer is in a closed position most of the time, such molded position will avoid creep in the material that might otherwise occur if resilient latching arm 88 were bent in such a closed position.

Figure 5B:
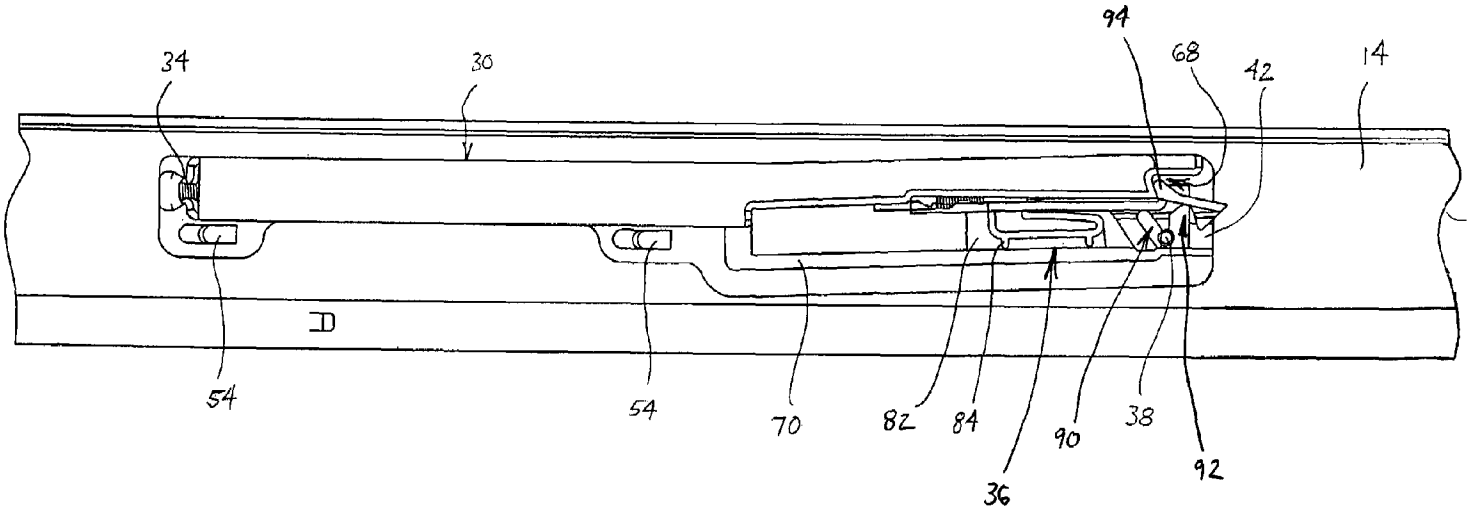
FIG. 5B is a top view of the self-closing mechanism mounted to the second drawer slide member of the first preferred embodiment, with the slider and drawer pin shown in their respective positions when the drawer is being opened and just after the latching member has been forced into the holding notch, or when the drawer is being closed and just prior to the latching member being forcibly removed from the holding notch.

As drawer D is withdrawn from cabinet C, pin 38 engages angled forward wall of first slot 90 and thereby causes slider 36 to move forward until latching portion 94 reaches holding notch 68 in housing 32. As slider 36 is sliding within housing 32, spring 34 tends to resist such forward motion and resilient latching arm 88 is essentially not permitted to bend, due to its contact with guide wall 66. As best seen in FIG. 6A, guide wall 66 preferably is parallel to the path of pin 38 to ensure that pin 38 remains substantially engaged within first slot 90 along this path. When slider 36 has advanced sufficiently that latching portion 94 reaches the end of guide wall 66, then resilient latching arm 88 is permitted to bend and latching portion 94 is forced into engagement with holding notch 68, as seen in FIG. 5B. This engagement is enhanced if latching portion 94 and holding notch 68 are at a slight inclined angle relative to the path of travel of slider 36, as shown. Once pin 38 leaves first slot 90, drawer D and its associated pin 38 are free to move further outward to the drawer slide's preselected limit of travel.

Figure 6B:
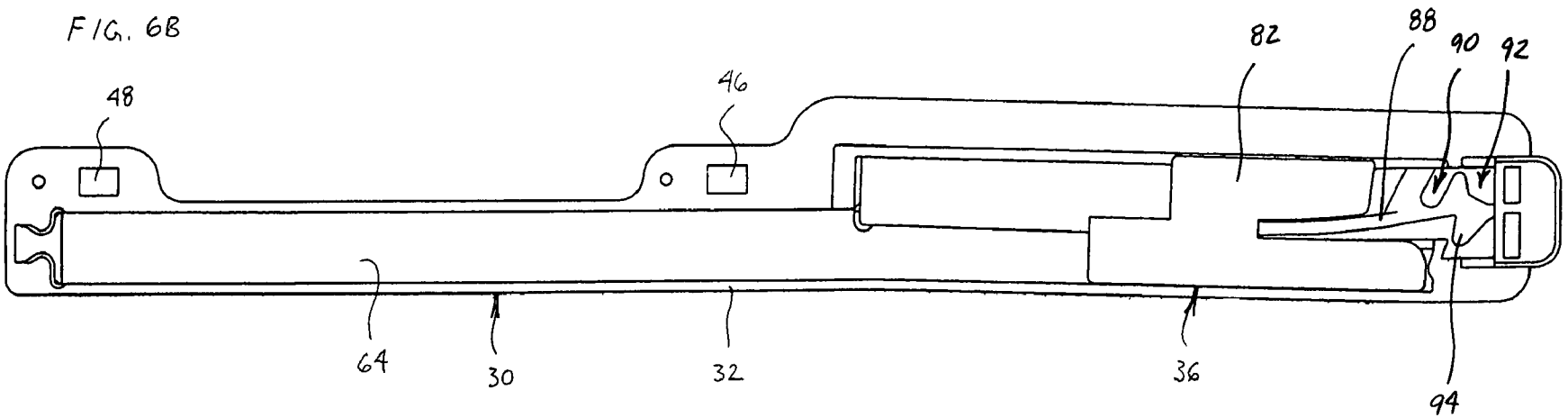
FIG. 6B is a bottom view of the housing and slider components of the closing mechanism of the first preferred embodiment with the slider setting idle at a second end of its travel.

Also, as seen in FIG. 6B, the preferred molded position of resilient latching arm 88 is such that at the end of travel of slider 36, latching portion 94 must be forced into substantial engagement with holding notch 68. If resilient latching arm 88 were molded so as to automatically seek a latched position, it would tend to snap into place, potential causing undesirable noise and greater resistance to being unseated when drawer D is being moved toward a closed position. Preferably, the path of slider 36 is slightly inclined relative to guide wall 66 so as to provide partial engagement when latching portion 94 reaches holding notch 68. This, in turn, reduces the likelihood that resilient latching arm 88 will snap against pin 38 when released from the latched position. However, the molded or assembled position of resilient latching arm 88 may be a matter of design choice, so as to enhance one or more performance characteristics of closing mechanism 30.

As drawer D is advanced toward a closed position within cabinet C, a preselected point in the travel, for instance at 2" from a fully closed position, pin 38 will again enter first slot 90. As pin 38 enters first slot 90 and engages its angled rearward wall, pin 38 will cause resilient latching arm 88 to bend and release latching portion 94 from holding notch 68. Once latching portion 94 is released, spring 34 will urge slider 36 toward its rearward or retracted position in housing 32. As slider 36 is urged rearward, the forward wall of first slot 90 engages pin 38, which is attached to drawer D directly or by way of a drawer mounted slide member 12, and thus results in the pulling of drawer D to its fully closed position within cabinet C. Spring 34 also will tend to hold drawer D in the closed position to prevent rebound or accidental rolling outward of drawer D.

Figure 5C:
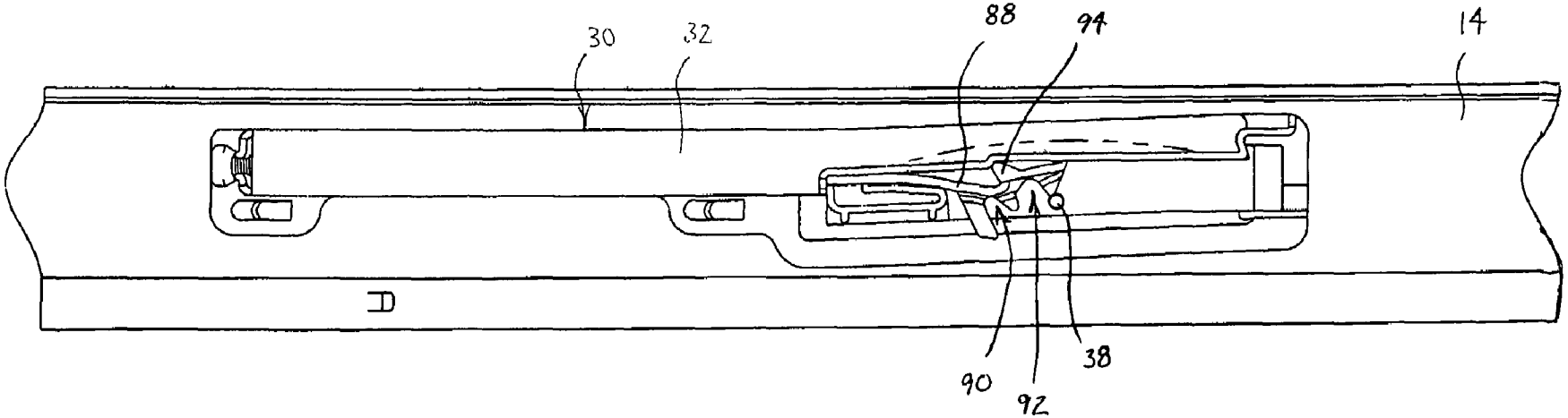
FIG. 5C is a top view of the self-closing mechanism mounted to the second drawer slide member of the first preferred embodiment, with the slider shown in a position wherein it prematurely returned to the closed position and the drawer pin is shown as the drawer is being closed and the drawer pin is reaching a reset position relative to the slider.

Second slot 92 is provided to permit a two-step resetting feature, in the event that latching portion 94 is inadvertently released from holding notch 68 prior to the ordinary reentry of pin 38 into first slot 90. If this occurs, slider 36 will be urged toward its rearward or retracted position by spring 34, in advance of the closing of drawer D. Thus, self-closing mechanism 30 must be reset for normal operation, with such resetting being facilitated by second slot 92. As best seen in FIG. 5C, if drawer D is moved toward a closed position after slider 36 has already reached its rearward position, pin 38 will engage resilient latching arm 88 and tend to force latching portion 94 into guide wall 66 until guide wall 66 temporarily bends (indicted by dashed lines) and/or resilient latching arm 88 bends backward on itself using latching portion 94 as a fulcrum, sufficiently to allow pin 38 to reach second slot 92. If pin 38 is in second slot 92, then when drawer D is opened, slider 36 will be forced forward again as pin 38 engages the forward wall of second slot 92 until slider 36 reaches the end of its travel and latching portion 94 is forced into engagement with holding notch 68 on housing 32. Now, if the drawer is closed, pin 38 will be able to re-engage first slot 90 and resume proper operation, thus completing the two-step reset process.

It will be appreciated by one of skill in the art that the invention also can be configured to have simply a one-step reset feature. If such is desire, second slot 92 can be eliminated and resilient latching arm 88 may be reconfigured to permit interference and bending of guide wall 66 and/or resilient latching arm 88 to achieve re-engagement of pin 38 with slot 90 upon return of drawer D to a closed position after inadvertent unlatching of latching portion 94 from holding notch 68.

Figure 8:
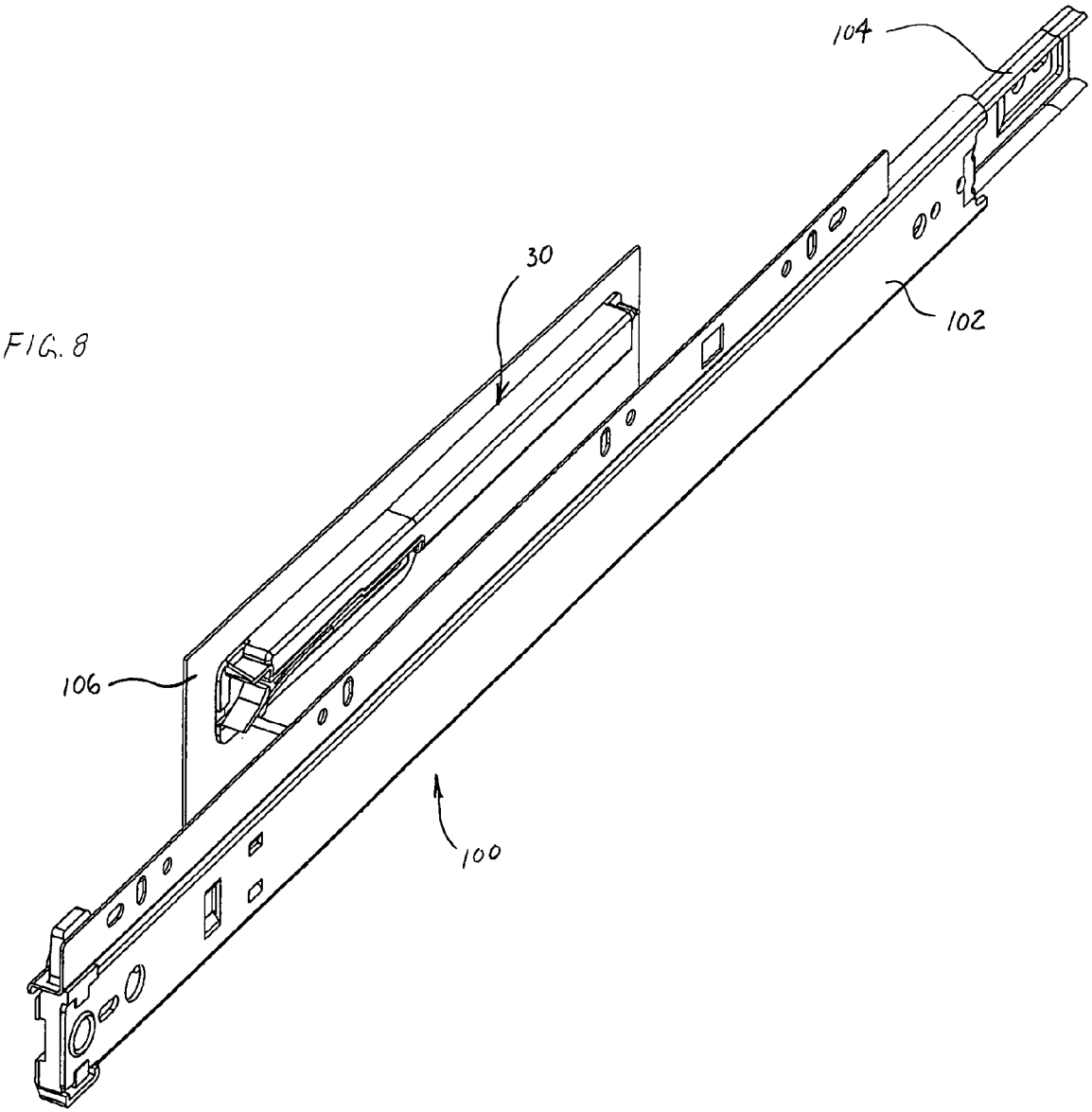
FIG. 8 is a perspective view of a second preferred embodiment of a closing device for a drawer consistent with the present invention and shown incorporated into a side mount drawer slide.

Turning to FIG. 8, a second preferred embodiment is shown in which the self-closing mechanism 30 is incorporated into a side mount, two piece drawer slide 100. In this alternative embodiment, first slide member 102 is configured for mounting to a drawer side and second drawer slide member 104 is configured for mounting to a cabinet wall. First and second drawer slide members 102 and 104 are slidably engaged, such as by use of bearings located therebetween.

Self-closing mechanism 30 is coupled to second drawer slide member 104 by extension plate 106. It will be appreciated that in this way, self-closing mechanism 30 can be made to interact with a pin 138 mounted to first slide member 102 or directly mounted to the drawer side, to obtain assisted closing of a side mounted drawer slide in a manner comparable to that described above in regard to an undermount drawer slide. While the second preferred embodiment in FIG. 8 is shown as a two-piece drawer slide, once again, one of skill in the art will understand that the closing device also may be incorporated into a side mounted drawer slide having more than two drawer slide members.

Figure 9:
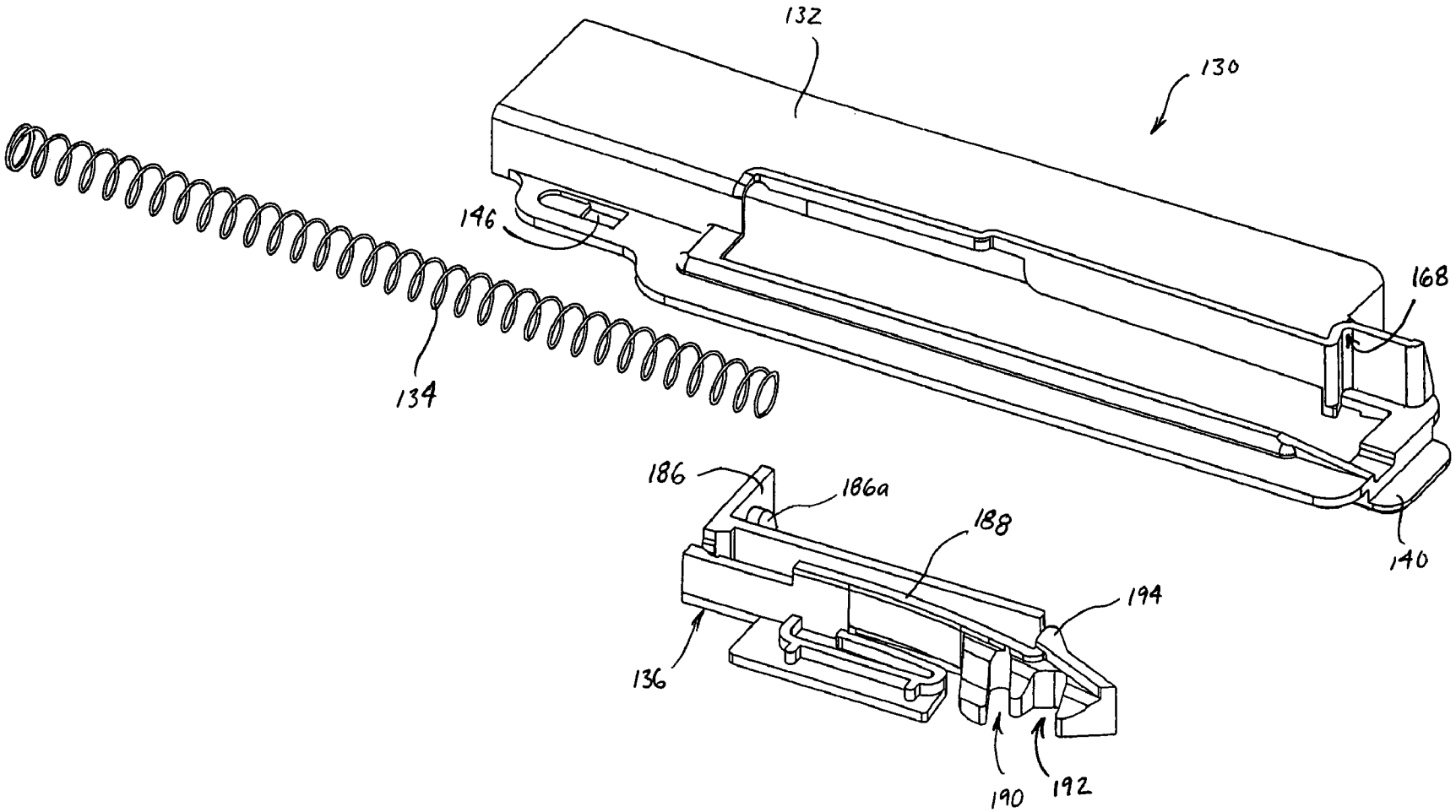
FIG. 9 is an exploded perspective view of a further preferred embodiment of a self closing mechanism for incorporation into an undermount or a side mount drawer slide.
Figure 10:
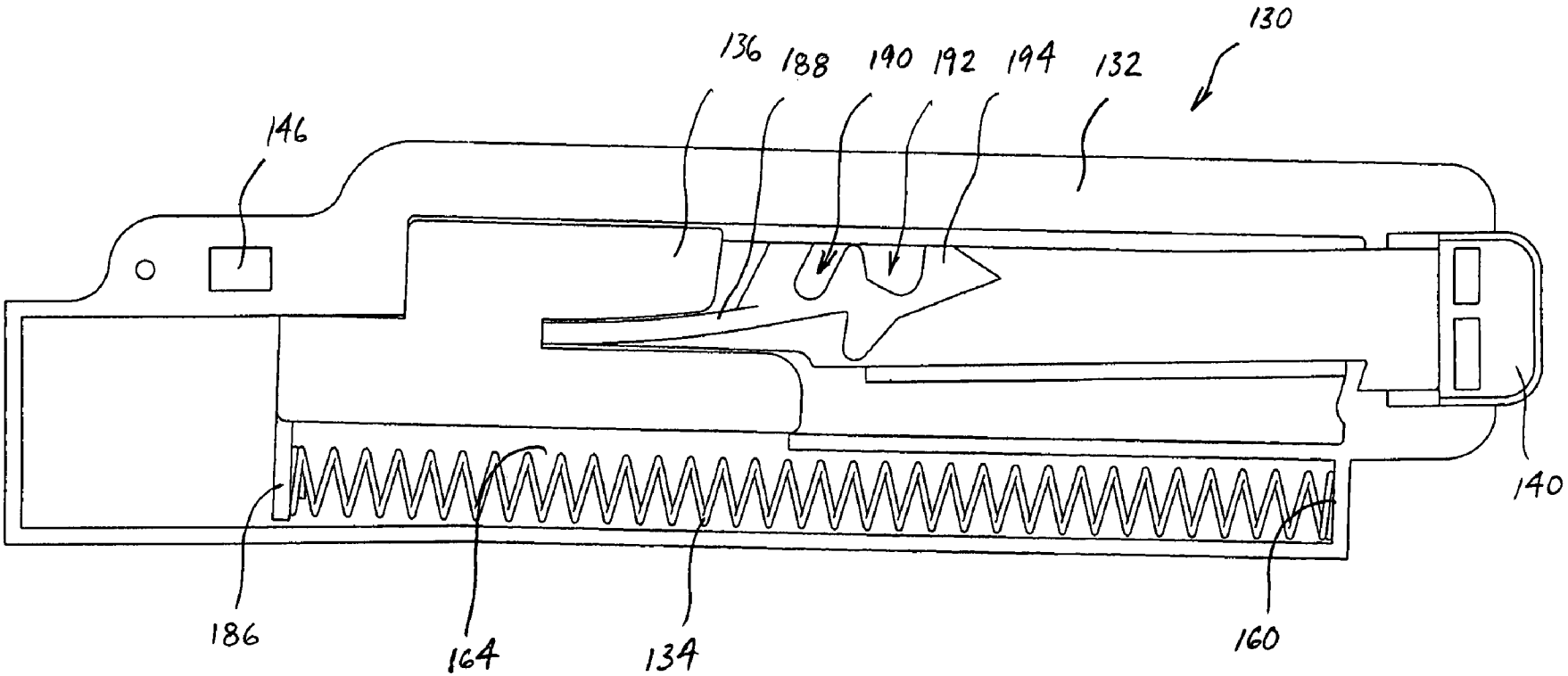
FIG. 10 is a bottom view of the further preferred embodiment of a self-closing mechanism shown with the slider at a first end of its travel.

Turning to FIGS. 9 and 10, an alternative preferred embodiment of a self-closing mechanism consistent with the invention is shown. In this embodiment, a self closing mechanism 130 is depicted as having a housing 132, a spring 134 and a slider 136. As shown, housing 132 is shorter but wider than previously illustrated housing 32. Housing 132 is configured to utilize spring 134 in compression, as opposed to use of spring 34 in tension. In this embodiment, when a pin (not shown) is in first slot 190 and the drawer is moved toward an open position, slider 136 is moved forward until latching portion 194 on resilient latching arm 188 reaches holding notch 168. In moving forward, slider 136 compresses spring 134. As the pin forces resilient latching arm 188 to bend, latching portion 194 engages holding notch 168 and self-closing mechanism 130 remains in an armed state until the drawer is moved toward a closed position sufficiently to have the pin re-engage first slot 190. At this point, the pin will be forced against the rearward wall of first slot 190 and will forcibly remove latching portion 194 from holding notch 168 to permit slider 136 to be pushed by spring 134 toward its rearward or retracted position.

In the alternative embodiment of FIGS. 9 and 10, housing 132 is quite similar to housing 32 of the prior embodiment in regard to the portion in which slider 136 is slidingly engaged. In turn, slider 136 is quite similar to slider 36 previously discussed above in detail. Accordingly, such detail will not be repeated, but it should be noted that spring 134 resides in housing channel 164 and engages a housing end wall 160 at the forward end and a spring engagement arm 186 of slider 136 at the rearward end. Spring engagement arm 186 also may have a protrusion 186*a* to assist in locating and centering spring 134*a* in housing channel 164. Also, it will be understood that housing 132 is shown as configured in a manner so as to prevent buckling of spring 134 when compressed. However, other means of preventing buckling of spring 134, such as by locating an elongated pin through the center of spring 134 also are contemplated with the present invention. Finally, self-closing mechanism 130 can be coupled to a slide member in various ways and it will be appreciated that in this embodiment, the mounting to a slide member is achieved in a similar manner to the prior embodiment, but with use of tab 140 to engage an aperture in a drawer slide member web, and aperture 146 to be engaged by a web mounting tab.

It will be appreciated that a closing mechanism for a drawer in accordance with the present invention may be provided in various configurations. Any variety of suitable materials of construction, configurations, shapes and sizes for the components and methods of connecting the components may be utilized to meet the particular needs and requirements of an end user. It will be apparent to those skilled in the art that various modifications can be made in the design and construction of such a self-closing mechanism without departing from the scope or spirit of the present invention, and that the claims are not limited to the preferred embodiments illustrated.

What is claimed is:

1. A closing device, for use in an article of furniture having furniture components including a furniture body and a drawer slidable in opposite directions rearward into and forward out of the furniture body, for moving the drawer rearward to a fully closed position within the furniture body, said closing device comprising:

a first slide member connected to the drawer;

a second slide member connected to the cabinet and slidably coupled to the first slide member;

a housing connected to the second slide member;

a slider slidably received in said housing, said slider having a sliding body portion and having a resilient latching arm, said resilient latching arm further comprising a slot and a latching portion, said resilient latching arm being bendable relative to said sliding body portion between a first position, wherein said latching portion is forced into engagement with a notch on said housing and a second position wherein said resilient latching arm is bent relative to it's first position thereby releasing said latching portion from said notch and said slider is permitted to move rearward within the housing;

a pin member connected to said first slide member and engageable with said slot in said resilient latching arm; and a spring disposed between said housing and said slider, said spring adapted to urge said slider to move rearward relative to said housing.

2. A closing device in accordance with claim 1, further comprising bearings disposed between said second slide member and said first slide member.

3. A closing device in accordance with claim 1, further comprising a third slide member slidably coupled to said first and second slide members.

4. A closing device in accordance with claim 1, wherein said first and second slide members are adapted to be used in an undermount drawer slide.

5. A closing device in accordance with claim 1, wherein said housing further comprises a tab and said second slide member further comprises an aperture adapted to receive said tab.

6. A closing device in accordance with claim 1, wherein said second slide member further comprises at least one bendable mounting tab and said housing further comprises at least one aperture adapted to receive a corresponding bendable mounting tab.

7. A closing device in accordance with claim 1, wherein said resilient latching arm further comprises a second slot, wherein said second slot is adapted to engage said pin member on said first drawer slide as said drawer is moved rearward toward a closed position if said pin member is unable to engage said first slot on said resilient latching arm.

8. A closing device in accordance with claim 1, wherein when said drawer is moved forward from a closed position toward an open position said spring is extended until said latching portion on said resilient latching arm engages said notch on said housing.

9. A closing device in accordance with claim 1, wherein a first end of said spring engages said housing and a second end of said spring engages said slider and said spring is disposed rearward of said slider.

10. A closing device in accordance with claim 1, wherein said resilient latching arm and said slider are formed as one integral piece.

11. A closing device in accordance with claim 1, wherein said housing is connected to a planar surface on said second slide member and said notch on said housing is located adjacent the end of a guide wall on said housing where said guide wall is in a plane perpendicular to the planar surface on said second slide member.

12. A closing device in accordance with claim 1, wherein said housing is connected to a planar surface on said second slide member and said housing further comprises a guide wall spaced from but parallel to said planar surface on said second slide member.

13. A closing device in accordance with claim 1, wherein said sliding body portion moves in a single path which is rectilinear and is not parallel to the path of said pin member.

14. A closing device in accordance with claim 1, wherein said first and second slide members are adapted to be used in a side mount drawer slide.

15. A closing device in accordance with claim 1, wherein when said drawer is moved forward from a closed position toward an open position said spring is compressed until said latching portion on said resilient latching arm engages said notch on said housing.

16. A closing device in accordance with claim 1, wherein a first end of said spring engages said housing and a second end of said spring engages said slider and said spring is disposed along side of said slider.

17. A closing device, for use in an article of furniture having furniture components including a furniture body connected to a first slide member and a drawer connected to a second slide member, the first slide member slidably coupled to the second slide member and the drawer being slidable in opposite directions rearward into and forward out of the furniture body, for moving the drawer rearward to a fully closed position within the furniture body, said closing device comprising:

a pin member adapted to be mounted to one of the furniture components or to one of the slide members;

a housing adapted to be mounted to the other of the furniture components or to the other of the slide members;

a slider having a sliding body portion and a resilient latching arm, wherein said sliding body portion slidably engages said housing;

said resilient latching arm having a latching portion and a slot, wherein said pin member is adapted to engage said slot and when said pin member engages said slot said slider is movable between a first position wherein said pin extends into said slot and a second position wherein said pin member forces said resilient latching arm to bend relative to said sliding body portion until said latching portion engages a notch on said housing and said pin member is removed from said slot; and a spring engaging said slider and said housing to urge said slider toward said first position such that when said pin member is engaged in said slot and said latching portion is not engaged in said notch on said housing, said furniture component or one of the slide members to which said pin member is mounted is urged to move relative to said outer furniture component or the other of the slide members so as to move said drawer rearward to a closed position.

18. A closing device in accordance with claim 17, further comprising bearings disposed between said first and second slide members.

19. A closing device in accordance with claim 17, further comprising a third slide member slidably coupled to said first and second slide members.

20. A closing device in accordance with claim 17, wherein said first and second slide members are adapted to be used in an undermount drawer slide.

21. A closing device in accordance with claim 17, wherein said resilient latching arm further comprises a reset slot, wherein said reset slot is adapted to engage said pin member as said drawer is moved rearward toward a closed position if said pin member is unable to engage said slot on said resilient latching arm.

22. A closing device in accordance with claim 17, wherein when said drawer is moved forward from a closed position toward an open position said spring is extended until said latching portion on said resilient latching arm engages said notch on said housing.

23. A closing device in accordance with claim 17, wherein a first end of said spring engages said housing and a second end of said spring engages said slider and said spring is disposed rearward of said slider.

24. A closing device in accordance with claim 17, wherein said slider moves in a single path which is rectilinear and is not parallel to the path of said pin member.

25. A closing device in accordance with claim 17, wherein said sliding body portion is movable in a single path relative to said housing, wherein said path is rectilinear.

26. A closing device in accordance with claim 1, wherein said sliding body portion moves in a single path wherein said path is rectilinear.

27. A closing device in accordance with claim 17, wherein said first and second slide members are adapted to be used in a side mount drawer slide.

28. A closing device in accordance with claim 17, wherein when said drawer is moved forward from a closed position toward an open position said spring is compressed until said latching portion on said resilient latching arm engages said notch on said housing.

29. A closing device in accordance with claim 17, wherein a first end of said spring engages said housing and a second end of said spring engages said slider and said spring is disposed along side of said slider.

* * * * *